US006662582B2

(12) United States Patent
Hirota et al.

(10) Patent No.: US 6,662,582 B2
(45) Date of Patent: Dec. 16, 2003

(54) DISPLACEMENT CONTROL VALVE

(75) Inventors: Hisatoshi Hirota, Tokyo (JP); Tomokazu Nakazawa, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 10/199,650

(22) Filed: Jul. 19, 2002

(65) Prior Publication Data

US 2003/0024257 A1 Feb. 6, 2003

(30) Foreign Application Priority Data

Jul. 31, 2001 (JP) ..... 2001-231627

(51) Int. Cl.[7] ..... F25B 1/00; F25B 49/00
(52) U.S. Cl. ..... 62/228.3; 417/222.2
(58) Field of Search ..... 62/228.3, 228.5; 417/222.2, 222.1, 269, 270, 213; 74/60

(56) References Cited

U.S. PATENT DOCUMENTS 6,267,562 B1 * 7/2001 Hirota ..... 417/222.2
6,449,971 B1 * 9/2002 Kimura et al. ..... 62/228.3
6,457,319 B1 * 10/2002 Ota et al. ..... 62/228.3
6,481,976 B2 * 11/2002 Kimura et al. ..... 417/222.2
6,481,977 B2 * 11/2002 Mameda et al. ..... 417/222.2
2001/0003573 A1 * 6/2001 Kimura et al. ..... 417/222.2

FOREIGN PATENT DOCUMENTS

JP 06341378 A * 12/1994 ..... F04B/49/00
JP 2001-132650 5/2001

* cited by examiner

*Primary Examiner*—Marc Norman
(74) *Attorney, Agent, or Firm*—Patterson, Thuente, Skaar & Christensen, L.L.C.

(57) ABSTRACT

A displacement control valve which is capable of shortening a time period for transition in operating displacement, and operating without necessitating a large solenoid force even if the size of the valve is increased so as to increase the amount of refrigerant. A differential pressure-sensing section is separated from a valve section, and caused to sense the differential pressure by a small-diameter piston rod such that even a small-sized solenoid section can set a differential pressure. A valve element, which is formed to have a larger diameter than that of the piston rod to increase the amount of refrigerant, is configured to operate as a member formed in one piece with a shaft. The pressure Pc from a pressure-regulating chamber is received at the axial opposite ends of a reduced-diameter portion of the shaft, and the suction pressure Ps from a suction chamber is received at the axial opposite ends of the one-piece member of the valve element and the shaft, thereby canceling out influence of the pressure Pc and the suction pressure Ps such that the valve element can be controlled only by the differential pressure sensed by the piston rod.

6 Claims, 3 Drawing Sheets

DISPLACEMENT CONTROL VALVE

BACKGROUND OF THE INVENTION (1) Field of the Invention

This invention relates to a displacement control valve, and more particularly to a displacement control valve for use in a variable displacement compressor for compressing a refrigerant gas in a refrigeration cycle for an automotive air conditioner.

(2) Description of the Related Art

A compressor used for compressing refrigerant in a refrigeration cycle for an automotive air conditioner is driven by an engine, and hence is not capable of controlling the rotational speed thereof. For this reason, a variable displacement compressor capable of changing the compression displacement for compressing refrigerant is employed so as to obtain adequate refrigerating capacity without being constrained by the rotational speed of the engine.

In the above-mentioned variable displacement compressor, compression pistons are connected to a wobble plate fitted on a shaft driven rotatably by the engine, and the angle of the wobble plate is changed to change the length of piston stroke for changing the discharge amount of the compressor.

The angle of the wobble plate is continuously changed by introducing part of the compressed refrigerant into a gastight pressure-regulating chamber and changing the pressure of the introduced refrigerant, thereby changing a balance between pressures applied to the opposite ends of each piston.

A compression displacement control device disclosed e.g. in Japanese Laid-Open Patent Publication (Kokai) No. 2001-132650 has a solenoid control valve arranged between a discharge port and a pressure-regulating chamber of a compressor or between the discharge port and a suction port of the same. This solenoid control valve opens and closes the communication such that a differential pressure across the solenoid control valve is maintained at a predetermined value. The predetermined value of the differential pressure can be set from outside by a current value. As a result, when the engine rotational speed increases, the pressure introduced into the pressure-regulating chamber is increased to shorten piston stroke to thereby reduce the displacement for compression, while when the engine rotational speed decreases, the pressure introduced into the pressure-regulating chamber is reduced to lengthen the piston stroke to thereby increase the displacement for compression, whereby the pressure of refrigerant discharged from the compressor is maintained at a constant level.

Although refrigerant generally used in a refrigeration cycle of an automotive air conditioner is a chlorofluorocarbon alternative HFC-134a, there has recently been developed a refrigeration cycle which causes the refrigerant to perform refrigeration in a supercritical region where the temperature of the refrigerant is above its critical temperature, e.g. a refrigeration cycle using carbon dioxide as refrigerant In the conventional solenoid control valve for the compression displacement control device, to maximize operating displacement of the variable displacement compressor, it is required to maximize the amount of refrigerant conducted out from the pressure-regulating chamber into the suction chamber to reduce pressure within the pressure-regulating chamber, but if the size of the valve is small, the amount of refrigerant conducted out is small, and hence transition to the maximum displacement operation takes time, which can degrade controllability of the compressor.

On the other hand, if the size of the valve is increased so as to increase the amount of refrigerant conducted out, the pressure-receiving area of the valve is also increased, and hence a large solenoid force is required to control the valve. Particularly in the refrigeration cycle using carbon dioxide as the refrigerant, since the pressure of refrigerant is increased to the supercritical region, the discharge pressure of the refrigerant becomes very high, so that the solenoid force for controlling the valve also becomes very large. This necessitates a huge solenoid, which causes an increase in the size of the solenoid valve and a resultant increase in manufacturing costs.

SUMMARY OF THE INVENTION

The present invention has been made in view of the above circumstances, and an object thereof is to provide a displacement control valve which is capable of performing transition between operating displacements in a reduced time period and operating without using a large solenoid force even when the size of the valve is increased so as to increase the amount of refrigerant.

In order to accomplish the object, a displacement control valve for controlling an amount of refrigerant conducted out from a pressure-regulating chamber into a suction chamber, such that a differential pressure between pressure in the suction chamber and pressure in a discharge chamber is held at a predetermined differential pressure, to thereby change an amount of the refrigerant discharged from a variable displacement compressor is provided. The displacement control valve is characterized by comprising the steps of; (a) a valve section for opening and closing a refrigerant passage between the pressure-regulating chamber and the suction chamber to control the amount of refrigerant conducted out from the pressure-regulating chamber to the suction chamber; (b) a differential pressure-sensing section that is formed separately from the valve section, for sensing the differential pressure between the pressure in the discharge chamber and the pressure in the suction chamber, thereby controlling a valve travel of the valve section; and (c) a solenoid section for having a current value supplied thereto changed to change a solenoid force thereof applied to a valve element of the valve section to thereby change the predetermined differential pressure so as to control a discharge amount of the refrigerant.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
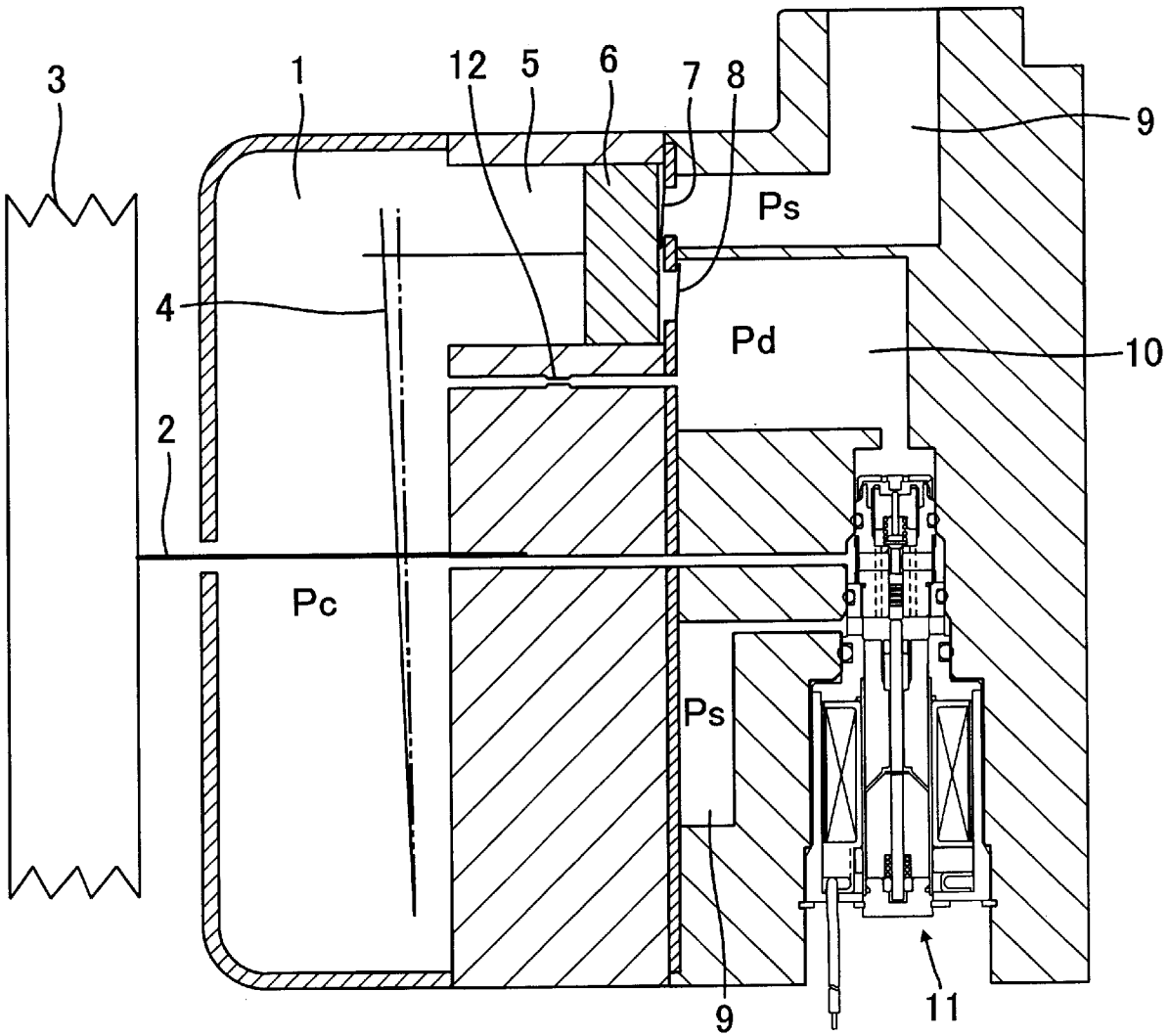
FIG. 1 is a cross-sectional view schematically showing the arrangement of a variable displacement compressor to which is applied a displacement control valve according to the invention.

FIG. 1 is a cross-sectional view schematically showing a variable displacement compressor to which is applied a displacement control valve according to the invention.

The variable displacement compressor includes a pressure-regulating chamber 1 formed airtight and a rotational shaft 2 rotatably supported in the pressure-regulating chamber 1. The rotational shaft 2 has one end extending outward from the pressure-regulating chamber 1 via a shaft sealing device, not shown, and having a pulley 3 fixed thereto which receives transmission of a driving force from an output shaft of an engine via a clutch and a belt. A wobble plate 4 is fitted on the rotational shaft 2 such that the inclination angle of the wobble plate 4 can be changed. A plurality of cylinders 5 (only one of which is shown in the figure) are arranged around the axis of the rotational shaft 2. In each cylinder 5, there is arranged a piston 6 for converting rotating motion of the wobble plate 4 to reciprocating motion. Each of the cylinders 5 is connected to a suction chamber 9 and a discharge chamber 10 via a suction relief valve 7 and a discharge relief valve 8, respectively. The respective suction chambers 9 associated with the cylinders 5 communicate with each other to form one chamber which is connected to an evaporator of a refrigeration cycle. Similarly, the respective discharge chambers 10 associated with the cylinders 5 communicate with each other to form one chamber which is connected to a gas cooler or a condenser of the refrigeration cycle.

In the variable displacement compressor, a differential pressure-sensing section receiving a discharge pressure Pd from the discharge chamber 10 and a suction pressure Ps from the suction chamber 9, and a displacement control valve 11 arranged in an intermediate portion of a refrigerant passage extending from the pressure-regulating chamber 1 to the suction chamber 9, for controlling the flow rate of a refrigerant in response to a differential pressure between the discharge pressure Pd and the suction pressure Ps sensed by the differential pressure-sensing section. Between the discharge chambers 10 and the pressure-regulating chamber 1, there is arranged an orifice 12.

In the variable displacement compressor constructed as above, as the rotational shaft 2 is rotated by the driving force of the engine, the wobble plate 4 fitted on the rotational shaft 2 rotates, which causes reciprocating motion of each piston 6 connected to the wobble plate 4. As a result, refrigerant within the suction chamber 9 is drawn into a cylinder 5, and compressed therein, and then the compressed refrigerant is delivered to the discharge chamber 10.

At this time, during normal operation, responsive to the discharge pressure Pd of the refrigerant discharged from the discharge chamber 10 and the suction pressure Ps of the same from the suction chamber 9 received by the differential pressure-sensing section, the displacement control valve 11 controls the amount of the refrigerant flowing from the pressure-regulating chamber 1 to the suction chamber 9 such that the differential pressure sensed by the differential pressure-sensing section is held at a predetermined differential pressure. As a result, the pressure Pc in the pressure-regulating chamber 1 is held at the predetermined pressure whereby the displacement of each cylinder 5 is controlled to a predetermined value.

Further, during transition to the minimum operating displacement, the displacement control valve 11 fully closes the valve to reduce the amount of the refrigerant conducted out from the pressure-regulating chamber 1 to the suction chamber 9 to zero, thereby shortening a time period over which the pressure Pc in the pressure-regulating chamber 1 is increased.

During transition to the maximum operating displacement, the displacement control valve 11 controls the valve thereof to be fully opened to maximize the amount of the refrigerant conducted out from the pressure-regulating chamber 1 to the suction chamber 9. At this time, the introduction of the refrigerant from the discharge chamber 10 into the pressure-regulating chamber 1 is performed through the orifice 12, whereas the refrigerant flows from the discharge chamber 10 into the pressure-regulating chamber 1 via the valve having a large valve hole. This causes the pressure Pc in the pressure-regulating chamber 1 to be rapidly reduced to shorten a time period for transition to the maximum displacement operation.

Next, the displacement control valve 11 according to the present invention will be described in detail.

Figure 2:
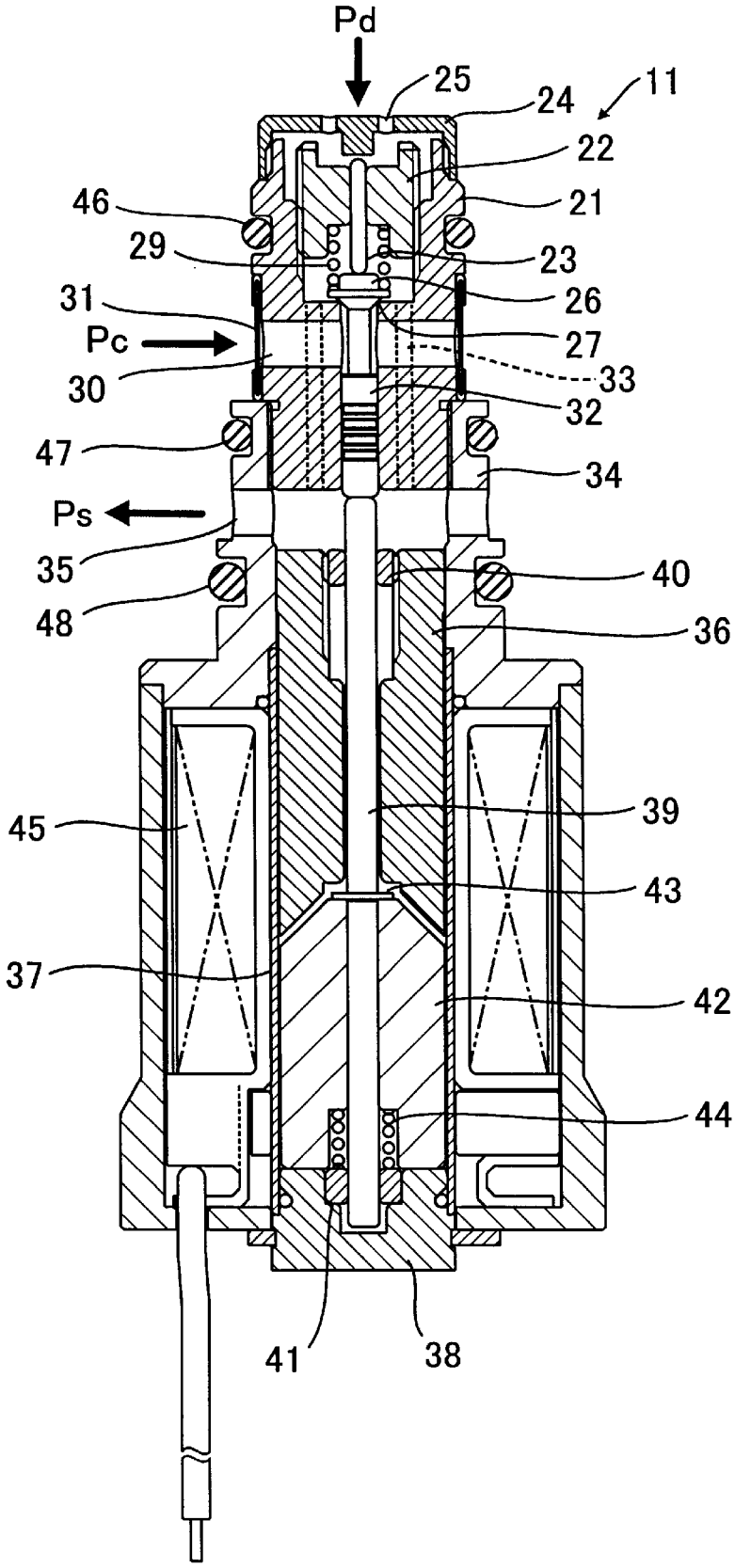
FIG. 2 is a central longitudinal sectional view showing a displacement control valve according to a first embodiment.

FIG. 2 is a central longitudinal sectional view showing a displacement control valve according to a first embodiment.

The displacement control valve 11 is comprised of a differential pressure-sensing section for sensing the discharge pressure Pd in the discharge chamber 10 and the suction pressure Ps in the suction chamber 9, a valve section for controlling the amount of refrigerant conducted out from the pressure-regulating chamber 1 to the suction chamber 9, and a solenoid section for setting a value for starting flow rate control from outside based on the differential pressure between the discharge pressure Pd and the suction pressure Ps, all of which are arranged on the same axis.

The differential pressure-sensing section includes a holder 22 screwed into an opening on an upper end side of a body 21, as viewed in the figure, and a small-diameter piston rod 23 axially movably held on the axis of the holder 22. The body 21 has a cap 24 screwed into an upper end portion thereof, as viewed in the figure. The cap 24 has a plurality of communication holes formed therethrough for introducing the discharge pressure Pd from the discharge chamber 10.

The valve section includes a valve element 26 arranged along the axis of the body 21, and a valve seat 27 formed in the body 21. The valve element 26 is urged in a valve-closing direction by a spring 29 arranged between the valve element 26 and the holder 22. The valve seat 27 has a valve hole communicating with a port 30 which is formed through the body 21. The port 30 is a portion connected to a refrigerant passage for introducing refrigerant from the pressure-regulating chamber 1 into the displacement control valve 11. The body 21 has a strainer 31 fitted thereon in a manner such that the strainer 31 covers the periphery of the port 30.

The body 21 is formed with a hollow cylindrical opening portion having an inner diameter equal to the inner diameter of the valve hole along the axis thereof, and has a shaft 32 arranged therein. A portion of the shaft 32 disposed in a hollow cylindrical opening portion communicating with the port 30 has a reduced diameter, and an upper end thereof is press-fitted in the valve element 26. A large-diameter portion of the shaft 32 has a periphery formed with a plurality of grooves for forming a labyrinth seal. Further, the body 21 has a plurality of communication holes 33 extending therethrough from a space where the valve element 26 is arranged, in a manner parallel to the axis of the body 21.

The body 21 is screwed into the upper opening of a body 34. A space in the body 34 at a location below the body 21 is communicated with a port 35 formed through the body 34. The port 35 is connected to a refrigerant passage for conducting out refrigerant to the suction chamber 9. Further, the body 34 has a lower opening to which are rigidly fixed an upper portion of a fixed core 36, and an upper end portion of a sleeve 37 of the solenoid section. The sleeve 37 has a lower end portion closed by a stopper 38. The solenoid section has a shaft 39 arranged along the axis thereof such that it extends through the fixed core 36. The shaft 39 has an upper end thereof axially slidably supported by a guide 40 screwed into a central opening of an upper portion of the fixed core 36, and a lower end thereof axially slidably supported by a guide 41 arranged in the stopper 38. The shaft 39 has a movable core 42 fitted on a lower portion thereof. The movable core 42 has an upper end brought into abutment with a stop ring 43 fitted on the shaft 39, and is urged upward, as viewed in the figure, by a spring 44 arranged between the movable core 42 and the guide 41. The sleeve 37 has a solenoid coil 45 arranged therearound.

Further, the body 21 has an O ring 46 arranged along the periphery thereof on a distal end side of the port 30. The body 34 has O rings 47, 48 arranged along the periphery thereof at respective locations on opposite sides of the port 35.

Here, description will be given of the relationship between pressures in the displacement control valve 11. First, in the vale element 26 and the shaft 32 secured thereto, the reduced-diameter portion of the shaft 32 receives the pressure Pc introduced from the pressure-regulating chamber 1 through the port 30, and respective effective pressure-receiving areas of the vale element 26 and the shaft 32 are configured to be equal to each other. As a result, the pressure Pc is applied to the vale element 26 in an upward direction, as viewed in the figure, whereas the same is applied to the shaft 32 in a downward direction, as viewed in the figure. On the other hand, the suction pressure Ps in the port 35 is applied not only to the lower end face of the shaft 32 but also to the valve element 26 via the communication holes 33. Therefore, the valve element 26 and the shaft 32 formed in one piece are configured such that they are free from influence of the pressure Pc from the pressure-regulating chamber 1 and influence of the suction pressure Ps from the suction chamber 9.

Further, in the differential pressure-sensing section, the piston rod 23 receives the discharge pressure Pd from the discharge chamber 10 at an upper end portion thereof, and receives the suction pressure Ps from the suction chamber 9 at a lower end portion thereof. As a result, a downward force, as viewed in the figure, dependent on the differential pressure between the discharge pressure Pd and the suction pressure Ps is applied to the piston rod 23, to urge the valve element 26 in a valve-closing direction. The piston rod 23 has a sufficiently smaller diameter than that of the shaft 32, and reduced pressure-receiving areas. This enables the piston rod 23 to sense the differential pressure between the discharge pressure Pd and the suction pressure Ps at the reduced pressure-receiving areas thereof. This makes it possible to use the same even in a refrigeration cycle using a refrigerant, such as carbon dioxide, whose pressure is raised up to a supercritical region.

Still further, the solenoid section generates a solenoid force corresponding to electric current supplied to the solenoid coil 45, and the shaft 39 urges the shaft 32 formed in one piece with the valve element 26 in the upward direction, as viewed in the figure.

Further, the suction pressure Ps in the port 35 is applied to gaps between the fixed core 36 and the guide 40, between the fixed core 36 and the shaft 39, between the fixed core 36 and the movable core 42, between the sleeve 37 and the movable core 42, and between the movable core 42 and the stopper 38, so that the inside of the solenoid section is filled with the suction pressure Ps.

In the displacement control valve 11 constructed as above, when no control current is supplied to the solenoid coil 45 of the solenoid section, there exists no solenoid force, so that the movable core 42 of the solenoid section is held away from the fixed core 36 due to a balance between the spring load of the spring 29 and that of the spring 44. The valve element 26 in abutment with the piston rod 23 is seated on the valve seat 27 by the differential pressure between the discharge pressure Pd and the suction pressure Ps. Therefore, the refrigerant passage for allowing refrigerant to flow from the pressure-regulating chamber 1 to the suction chamber 9 is closed, whereby the pressure Pc of the pressure-regulating chamber 1 becomes closer to the discharge pressure Pd, resulting in the minimized difference in pressure applied to the opposite faces of the piston 6. As a result, the wobble plate 4 is controlled to a degree of inclination which minimizes the stroke of the pistons 6, whereby the variable displacement compressor is operated with the minimum operating displacement.

When a maximum control current is supplied to the solenoid coil 45 of the solenoid section, the movable core 42 is attracted by the fixed core 36 to be moved upward, as viewed in the figure, whereby the valve element 26 is fully opened. This makes it possible to maximize the amount of the refrigerant flowing from the pressure-regulating chamber 1 into the suction chamber 9 through the port 30, between the valve element 26 and the valve seat 27, the communication holes 33, and the port 35, thereby sharply reducing the pressure Pc in the pressure-regulating chamber 1, which contributes to increasing a speed at which transition to the maximum operating displacement takes place.

Further, during normal control in which a predetermined control current is supplied to the solenoid coil 45 of the solenoid section, the movable core 42 is attracted by the fixed core 36 to be moved upward, depending on the magnitude of the control current. This makes it possible to hold the valve element 26 at a predetermined degree of opening thereof. Now, when the differential pressure between the discharge pressure Pd and the suction pressure Ps becomes higher than a solenoid force set by the solenoid section, the valve element 26 is moved in the valve-closing direction to narrow the amount of the refrigerant flowing from the pressure-regulating chamber 1 to the suction chamber 9, thereby performing displacement control in a direction of reducing the operating displacement.

Figure 3:
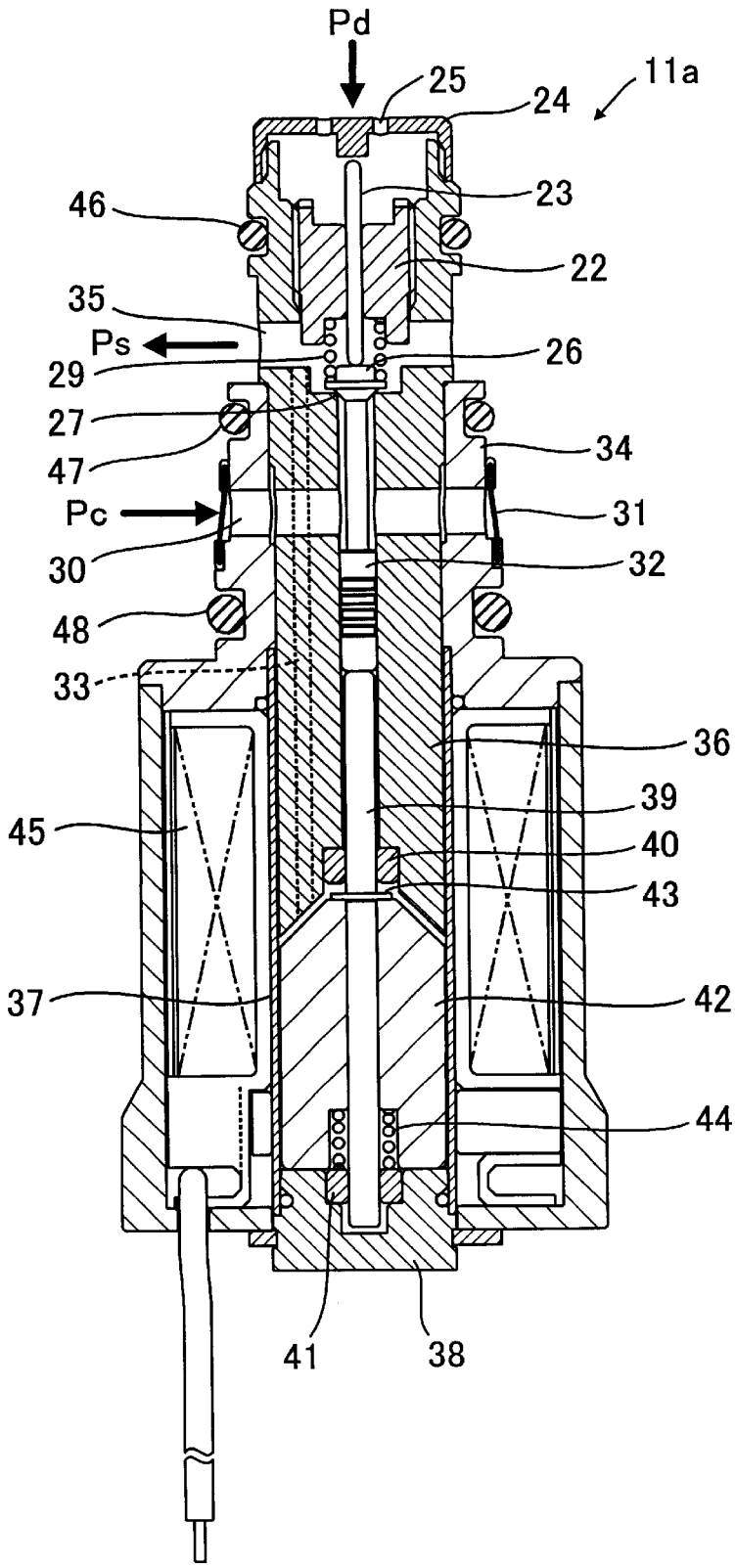
FIG. 3 is a central longitudinal sectional view showing a displacement control valve according to a second embodiment.

FIG. 3 is a central longitudinal sectional view showing a displacement control valve according to a second embodiment. In FIG. 3, component parts and elements similar to those shown in the FIG. 2 are designated by identical reference numerals, and detailed description thereof is omitted.

According to the displacement control valve 11*a* of the second embodiment, the port 30 communicating with the pressure-regulating chamber 1 and the port 35 communicating with the suction chamber 9 are arranged inversely to the arrangement of the displacement control valve according to the first embodiment. Further, the body 21 and the fixed core 36 are formed in one piece, and the communication hole 33 for equalizing pressure in the port 35 in communication with the suction chamber 9 and pressure in the solenoid section and on a lower end side of and the shaft 32, as viewed in the figure, is formed such that it extends even through the fixed core 36.

Similarly to the displacement control valve 11 according to the first embodiment, the displacement control valve 11*a* as well is configured such that the valve element 26 and the shaft 32 formed in one piece have the influence of the pressure Pc from the pressure-regulating chamber 1 and that of the suction pressure Ps from the suction chamber 9 canceled out, and controlled only by the differential pressure between the discharge pressure Pd and the suction pressure Ps. Further, a portion for sensing the differential pressure between the discharge pressure Pd and the suction pressure Ps is formed by the piston rod 23 which has a reduced diameter and is separate from the valve section, and this piston rod 23 is brought into abutment with the valve element 26.

Therefore, with the above configuration, the displacement control valve 11*a* operates similarly to the displacement control valve 11 according to the first embodiment.

As described heretofore, the displacement control valve according to the invention is configured such that a differential pressure-sensing section and a valve section are separate from each other, and the differential pressure-sensing section is caused to sense the differential pressure by a small-diameter piston rod thereof to reduce a solenoid force for setting the differential pressure, while a valve element which the valve travel is controlled by the piston rod is increased in size so as to increase the flow rate of refrigerant. Further, the valve element is configured such the pressure from the pressure-regulating chamber and the suction pressure from the suction chamber are canceled out such that the valve element can be controlled only by the differential pressure sensed by the piston rod. This allows the solenoid force to be reduced, and therefore, it is possible to provide a small-sized and inexpensive displacement control valve with a solenoid section reduced in size. Further, the valve element for controlling the amount of refrigerant flowing from the pressure-regulating chamber to the suction pressure is increased in size, so that it is possible to shorten a time period required for transition to the maximum operating displacement.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A displacement control valve for controlling an amount of refrigerant conducted out from a pressure-regulating chamber into a suction chamber, such that a differential pressure between pressure in the suction chamber and pressure in a discharge chamber is held at a predetermined differential pressure, to thereby change an amount of the refrigerant discharged from a variable displacement compressor, characterized by comprising:

a valve section for opening and closing a refrigerant passage between the pressure-regulating chamber and the suction chamber to control the amount of refrigerant conducted out from the pressure-regulating chamber to the suction chamber;

a differential pressure-sensing section that is formed separately from the valve section, for sensing the differential pressure between the pressure in the discharge chamber and the pressure in the suction chamber, thereby controlling a valve travel of the valve section; and a solenoid section for having a current value supplied thereto changed to change a solenoid force thereof applied to a valve element of the valve section to thereby change the predetermined differential pressure so as to control a discharge amount of the refrigerant.

2. The displacement control valve according to claim 1, wherein the differential pressure-sensing section receives the pressure from the discharge chamber and the pressure from the suction chamber at opposite ends thereof, and one of the opposite ends for receiving the pressure from the suction chamber has a piston rod in abutment with the valve element of the valve section.

3. The displacement control valve according to claim 2, wherein the valve section includes a valve element that has a diameter larger than that of the piston rod of the differential pressure-sensing section and opens and closes the refrigerant passage between the pressure-regulating chamber and the suction chamber, and a shaft arranged between the valve element and the solenoid section, for canceling out influence of the pressure from the pressure-regulating chamber and influence of the pressure from the suction chamber applied to front and rear portions of the valve element.

4. The displacement control valve according to claim 3, wherein the shaft includes a large-diameter portion having the same cross-sectional area as a pressure-receiving area of the valve element for receiving the pressure of the pressure-regulating chamber, and a reduced-diameter portion for connecting between the valve element and the large-diameter portion, a refrigerant passage from the pressure-regulating chamber being communicated with a space where the reduced-diameter portion extends, a space on a side of the valve element in abutment with the piston rod and a space where an end face of the large-diameter portion on a side of the solenoid section is located being communicated with each other by a communication hole.

5. The displacement control valve according to claim 4, wherein the solenoid section is communicated with the space on the side of the valve element in abutment with the piston rod, and thereby filled with the pressure from the suction chamber.

6. The displacement control valve according to claim 1, wherein the displacement control valve is applied to a variable displacement compressor for use in a refrigeration cycle causing the refrigerant to perform refrigerating operation in a supercritical region in which a temperature of the refrigerant is above a supercritical temperature thereof.

* * * * *